US008629826B2

(12) United States Patent
Liao et al.

(10) Patent No.: US 8,629,826 B2
(45) Date of Patent: Jan. 14, 2014

(54) METHOD FOR DRIVING LIQUID CRYSTAL DISPLAY AND NON-TRANSITORY STORAGE MEDIUM THEREOF

(75) Inventors: Mu-Shan Liao, Xizhou Township, Changhua County (TW); Yuan-Jing Chang, Kaohsiung (TW); Hung-Chun Li, Longtan Township, Taoyuan County (TW)

(73) Assignee: Chunghwa Picture Tubes, Ltd., Bade, Taoyuan (TW)

( * ) Notice: Subject to any disclaimer, the term of this patent is extended or adjusted under 35 U.S.C. 154(b) by 933 days.

(21) Appl. No.: 12/756,418

(22) Filed: Apr. 8, 2010

(65) Prior Publication Data

US 2011/0025664 A1 Feb. 3, 2011

(30) Foreign Application Priority Data

Jul. 28, 2009 (TW) ..... 98125439 A

(51) Int. Cl.
*G09G 3/36* (2006.01)

(52) U.S. Cl.
USPC ..... 345/96

(58) Field of Classification Search
USPC ..... 345/96, 209
See application file for complete search history.

(56) References Cited

U.S. PATENT DOCUMENTS

| | | | | |
|---|---|---|---|---|
| 6,166,725 | A * | 12/2000 | Isami et al. | 345/209 |
| 2002/0089485 | A1* | 7/2002 | Youn | 345/99 |
| 2002/0175907 | A1* | 11/2002 | Sekiya et al. | 345/211 |
| 2003/0090602 | A1* | 5/2003 | Kim | 349/43 |
| 2004/0032386 | A1* | 2/2004 | Pai | 345/96 |
| 2004/0263466 | A1* | 12/2004 | Song et al. | 345/100 |
| 2005/0219190 | A1* | 10/2005 | Lee et al. | 345/96 |

* cited by examiner

*Primary Examiner* — Chanh Nguyen
*Assistant Examiner* — Robert Stone
(74) *Attorney, Agent, or Firm* — Chih Feng Yeh; Huntington IP Co., Ltd.

(57) ABSTRACT

The present invention discloses a method for driving thin film transistor liquid crystal display (TFT-LCD) and the storage medium for storing computer program representative of the method thereof. The method utilizes a timing controller to send polarity control signals to a plurality of source drivers in a TFT-LCD panel for changing the polarity distribution of the liquid crystal molecules in the panel. The method is characterized by dynamically changing the positions of polarity inversion for alleviating the problem of undercharging under high resolution and high frequency conditions; utilizing both polar and reverse polar driving signals for solving the problem of color shift in "checker board" checking signals; and providing a mechanism for mending the problem of undercharging of the first horizontal line.

16 Claims, 12 Drawing Sheets

| | | | | | |
|---|---|---|---|---|---|
| R(+)<br>6V<br><br>211 | G(−)<br>4V<br><br>212 | B(+)<br>6V<br><br>213 | K(−)<br>0V<br><br>214 | K(+)<br>10V<br><br>215 | K(−)<br>0V<br><br>216 |
| K(+)<br>10V<br><br>221 | K(−)<br>0V<br><br>222 | K(+)<br>10V<br><br>223 | R(−)<br>4V<br><br>224 | G(+)<br>6V<br><br>225 | B(−)<br>4V<br><br>226 |
| R(+)<br>6V<br><br>231 | G(−)<br>4V<br><br>232 | B(+)<br>6V<br><br>233 | K(−)<br>0V<br><br>234 | K(+)<br>10V<br><br>235 | K(−)<br>0V<br><br>236 |

FIG. 2 (Prior Art)

| | | | | | |
|---|---|---|---|---|---|
| R(+)<br>6V<br>6111 | G(−)<br>4V<br>6112 | B(+)<br>6V<br>6113 | K(−)<br>0V<br>6114 | K(+)<br>10V<br>6115 | K(−)<br>0V<br>6116 |
| K(+)<br>10V<br>6121 | K(−)<br>0V<br>6122 | K(+)<br>10V<br>6123 | R(−)<br>4V<br>6124 | G(+)<br>6V<br>6125 | B(−)<br>4V<br>6126 |
| R(+)<br>6V<br>6131 | G(−)<br>4V<br>6132 | B(+)<br>6V<br>6133 | K(−)<br>0V<br>6134 | K(+)<br>10V<br>6135 | K(−)<br>0V<br>6136 |

FIG. 6A

| | | | | | |
|---|---|---|---|---|---|
| R(−)<br>4V<br>6211 | G(+)<br>6V<br>6212 | B(−)<br>4V<br>6213 | K(+)<br>10V<br>6214 | K(−)<br>0V<br>6215 | K(+)<br>10V<br>6216 |
| K(−)<br>0V<br>6221 | K(+)<br>10V<br>6222 | K(−)<br>0V<br>6223 | R(+)<br>6V<br>6224 | G(−)<br>4V<br>6225 | B(+)<br>6V<br>6226 |
| R(−)<br>4V<br>6231 | G(+)<br>6V<br>6232 | B(−)<br>4V<br>6233 | K(+)<br>10V<br>6234 | K(−)<br>0V<br>6235 | K(+)<br>10V<br>6236 |

FIG. 6B

METHOD FOR DRIVING LIQUID CRYSTAL DISPLAY AND NON-TRANSITORY STORAGE MEDIUM THEREOF

FIELD OF THE INVENTION

The present invention is generally related to the method for driving liquid crystal display (LCD) and, more particularly, to an improved polarity reversion driving method for thin film transistor liquid crystal display (TFT-LCD).

DESCRIPTION OF THE PRIOR ART

For improving the quality of displaying images from the LCD display panel, the alternating current (AC) driving approach is often utilized for preventing the liquid crystal molecules from being constantly polarized. Several driving approaches are often utilized, such as frame inversion, line inversion, dot inversion, etc. When frame inversion driving approach is utilized, several shortcomings, such as flicking and unbalance of images, are often accompanied due to all the LCD capacitors being charged with the same polarity in each frame. For overcoming the above-mentioned shortcomings, line inversion and dot invention driving approaches have been developed by the industry. For example, in a line inversion driving approach, because capacitors along every two neighboring lines in a frame are charged in opposite polarities of voltage, the flicking problem is alleviated by the averaging effect. In a dot inversion driving approach, because capacitors at every two neighboring dots are charged in opposite polarities, a better averaging effect than which provided by the frame inversion for lowering the flicking problem is thus provided. However, although the dot inversion driving approach provides a best averaging effect and a lowest flicking problem among the above-mentioned approaches, it consumes the electric power most. Therefore, the dot inversion approach may have problems when being applied to, for example, a portable device, for shortcomings of lower endurance of electric power and/or a larger volume and weight of the expected and needed batteries.

As it faces a trade-of between the electric power consumption and the averaging effect, the prior art provides a multi-line inversion technique, for trying to decrease the times of inversions and thus to lower the electric power consumption. However, the multi-line inversion technique does not overcome the shortcoming of undercharging (insufficiency of charging) occurred at the inversion positions. Therefore, several problems, such as the lines with unbalanced brightness and flicking images, are thus generated.

Nowadays, the "1 line" inversion and the "1+2 line" inversion modes are relatively common utilized in the industries, and their timing diagrams are illustrated in FIGS. 1A and 1B. FIG. 1A shows the polarity distribution in frame "n−1" F(n−1), which comprising the information of start pulse vertical signal (STV) 111, clock signal (CLKV) 112, RGB data 113, "1 line" polarity distribution signal 114*a*, and "1+2 line" polarity distribution signal 114*b*. Similarly, FIG. 1B shows the polarity distribution in frame F(n), which comprising the information of STV 121, CLKV 122, RGB data 123, "1 line" polarity distribution signal 124*a*, and "1+2 line" polarity distribution signal 124*b*. The continuous frames comprise the alternate frames of F(n−1) and F(n). Take "1+2 line" as an example, the polarity at the positions of 116/126, 117/127, 118/128, and 119/129 are continuously been inversing, and thus the problems of unbalanced brightness at corresponding lines are emerged due to undercharging of this polarity inversion positions. In addition, the above-mentioned approach consumes electric power badly.

Furthermore, when the line inversion driving approach is applied with "1×1" checker board signals which are generally utilized as testing signals in industries, a green color shift problem is occurred, as illustrated in FIG. 2. In FIG. 2, it is supposed that the LCD panel is in normally white (NW) mode and the common voltage $V_{COM}$ is about 5V, and thus it is in biased state when each of the pixels is applied with about 0V or 10V. Consequently, pixels 214, 215, 216, 221, 222, 223, 234, 235, and 236 are displayed with black (opaque, marked as "K"), and pixels 211, 212, 213, 224, 225, 226, 231, 232, and 233, marked with R (red), G (green) or B (blue), are light transmissible. Taking the first row and second for example, the electric voltage is varied from about 6V to 10V (increasing about 4V) between pixels 211 and 221, and the electric voltage is varied from about 4V to 0V (decreasing about 4V) between pixels 212 and 222. The above-mentioned variations of the electric voltages are in opposite trends and able to be balanced. Further, the electric voltage is varied from about 0V to 4V (increasing about 4V) between pixels 214 and 224, and the electric voltage is varied from about 10V to 6V (decreasing about 6V) between pixels 215 and 225. The above-mentioned variations of the electric voltages are also in opposite trends and thus able to be balanced. However, the electric voltage is varied from about 6V to 10V (increasing about 4V) between pixels 213 and 223, and the electric voltage is varied from about 0V to 4V (increasing about 4V) between pixels 216 and 226. Therefore, the above-mentioned variations of the electric voltages are in the same trend and thus not able to be balanced. Being balanced or not is related to the coupling effect caused by the voltage increasing of both pixels 213/223 and 216/226, and the common voltage is thus lifted. Due to the increasing of the common voltage, the difference between the pixel 225 (green) and the common voltage is reduced. Thus, the voltage bias of the green pixel 225 is lowered, and the brightness of the green pixel 225 becomes stronger. In contrast, via the increasing of the common voltage, the differences between the pixel 224 (red)/pixel 226 (blue) and the common voltage are enlarged. Thus, the voltage biases of the red pixel 224 and blue pixel 226 are increased, and the brightness of each the red pixel 224 and blue pixel 226 becomes weaker. Thus, it results in the overall image showing green color shift (green color being excessive) under the checker board testing signals. The similar problems are happened in the second and the third rows. By the voltage decreasing of the pixel 223/233 and the pixel 226/236, the common voltage is pulled down. Consequently, the brightness of the pixel 232 (green) is enlarged by a decreased voltage bias, the brightness of each the pixel 231 (red) and the pixel 233 (blue) is reduced by increased voltage biases. It results in the overall image showing green color shift under the checker board testing signals as well.

Therefore, it is needed to provide a method for driving LCD, for overcoming the existed problem of brightness unbalance and the problem of green color shift under the checker board testing signals, which providing unexpected effect in view of the prior art.

SUMMARY OF THE INVENTION

In one aspect of the embodiments, the present invention provides a method for driving liquid crystal display, utilizing a timing controller to send polarity control signals to a plurality of source drivers in a display panel. The method comprises: step (a), setting value of K; step (b), setting each of first pixels of 1 to R horizontal lines of frames F(2R−2) as first polarity, setting each of first pixels of R+1 to R+K horizontal lines of the frames F(2R−2) as second polarity, and alternating polarity of each of first pixels of every K horizontal lines thereafter of the frames F(2R−2) as alternate the first polarity and the second polarity, wherein R is natural number from 1 to K, and K is natural number which is smaller or equal to number of the horizontal lines subtracting 1; setting each of first pixels of 1 to R horizontal lines of frames F(2R−1) as the second polarity, setting each of first pixels of R+1 to R+K horizontal lines of the frames F(2R−1) as the first polarity, and alternating polarity of each of first pixels of every K horizontal lines thereafter of the frames F(2R−1) as alternate the second polarity and the first polarity; step (c), repeating step (b) while substituting R from 1 to K with interval of 1; and step (d), displaying the frames F(2R−2) and F(2R−1) according to sequence generated by comparing values of 2R−2 and 2R−1 substituted with different R.

In preferred embodiments of the present invention, the sequence is ascending order or descending order sequence.

In preferred embodiments of the present invention, the polarity control signals are AC control signals.

In preferred embodiments of the present invention, the method further comprises a frame initial position setting step, to present the frames F(2R−2) and F(2R−1) as F(n+(2R−2)) and F(n+(2R−1)), for identifying frame initial positions.

In preferred embodiments of the present invention, the method further comprises a frame recurring step, to reiteratively display frames for satisfying a renew frequency M while M>K.

In preferred embodiments of the present invention, the method further comprises a horizontal line pixel distribution step, to set polarities of second pixels of each of the horizontal lines of the frames F(2R−2) and F(2R−1) as opposite to polarities of the first pixels, to set polarities of third pixels as opposite to the polarities of the second pixels, and to set polarities of pixels thereafter with the same pattern, for generating polarity distribution comprising alternate the first polarity and the second polarity; wherein if the first pixels are set as the first polarity, then the second pixels are set as the second polarity.

In preferred embodiments of the present invention, the method further comprises a polarity distribution setting step, for assigning add ones and even ones of the plurality of source drivers with polar driving signals and reverse polar driving signals.

In preferred embodiments of the present invention, the method further comprises an undercharging improving step, for changing the polarity of polarity control signals to be the same with polarity of the first pixels before the polarity of first pixels are generated.

In preferred embodiments of the present invention, the method further comprises an undercharging improving step comprising: providing a plurality of data storage unit; providing a data enable signal (or data initiating signal); storing polarity data of the first pixels of the first horizontal lines of the frames F(2R−2) and (2R−1) into first data storage unit of the plurality of data storage unit; setting first pixels of next horizontal lines of the frames F(2R−2) and F(2R−1) as identical to the first pixels of the first horizontal lines and storing into the first data storage unit; delaying start pulse vertical signal one unit time according to the data enable signal; storing polarity data of first pixels of second horizontal lines of the frames F(2R−2) and (2R−1) into second data storage unit of the plurality of data storage unit; transmitting data stored in the first data storage unit to the plurality of source drivers when the starting pulse vertical signal is started; transmitting data stored in the second data storage unit to the plurality of source drivers in next timing unit; and reiteratively storing polarity data of first pixels of horizontal lines thereafter to the plurality of data storage units, and transmitting the polarity data of first pixels of horizontal lines thereafter to the plurality of source drivers in the next timing unit.

In another aspect of the embodiments, the present invention provides a storage medium readable by a timing controller. The storage medium stores a program of instructions executable by the timing controller to perform a method for driving a panel of a liquid crystal display, for sending polarity control signals to a plurality of source drivers in the panel. The method comprises the steps mentioned above.

BRIEF DESCRIPTION OF THE DRAWINGS

FIG. 2 illustrates the green color shift with "1×1" checker board testing signals according to a prior art;

FIGS. 6A and 6B illustrate the displaying frames under "1×1" checker board testing signals according to the embodiments of the present invention.

DESCRIPTION OF THE PREFERRED EMBODIMENT

Figure 1A:
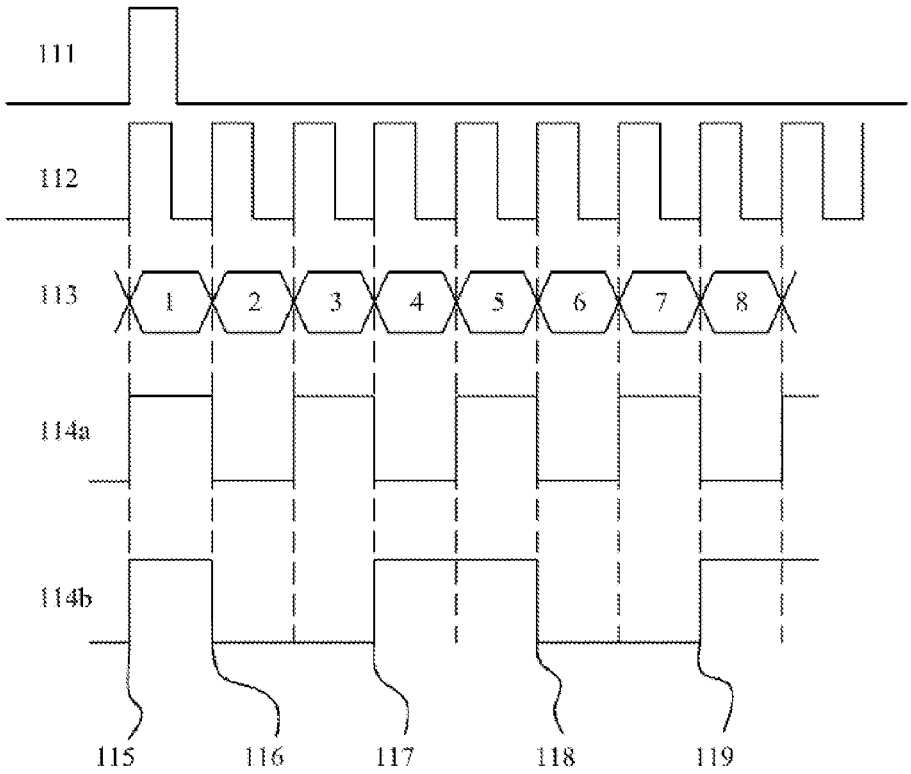
FIG. 1A (Prior Art)
FIGS. 1A and 1B illustrate the timing diagram according to a prior art.
Figure 1B:
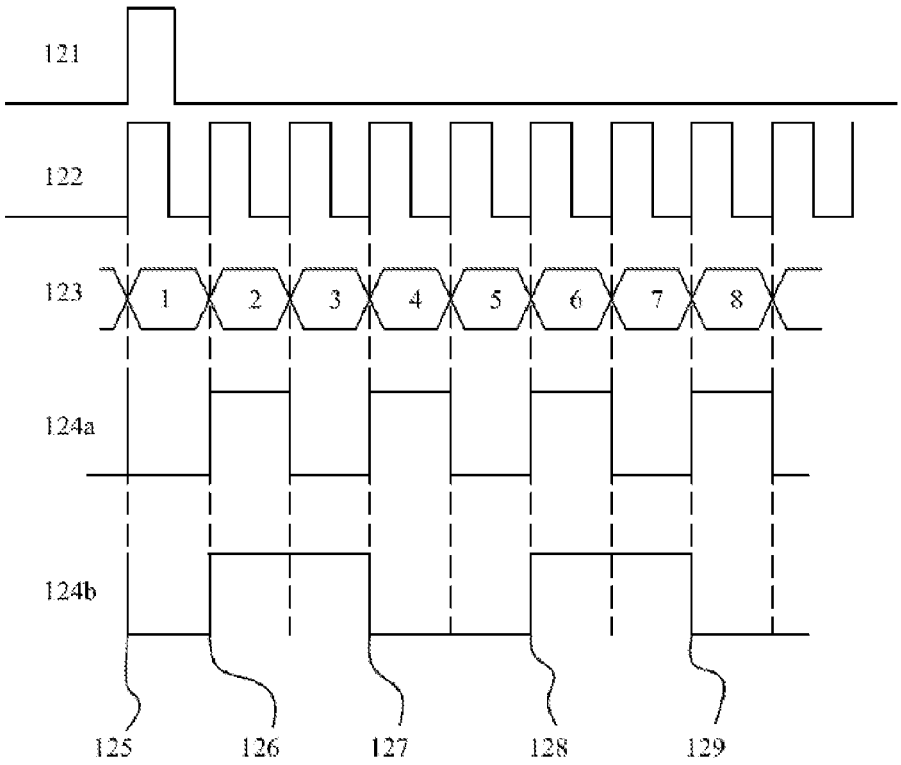
FIG. 1B (Prior Art)
Figure 3A:
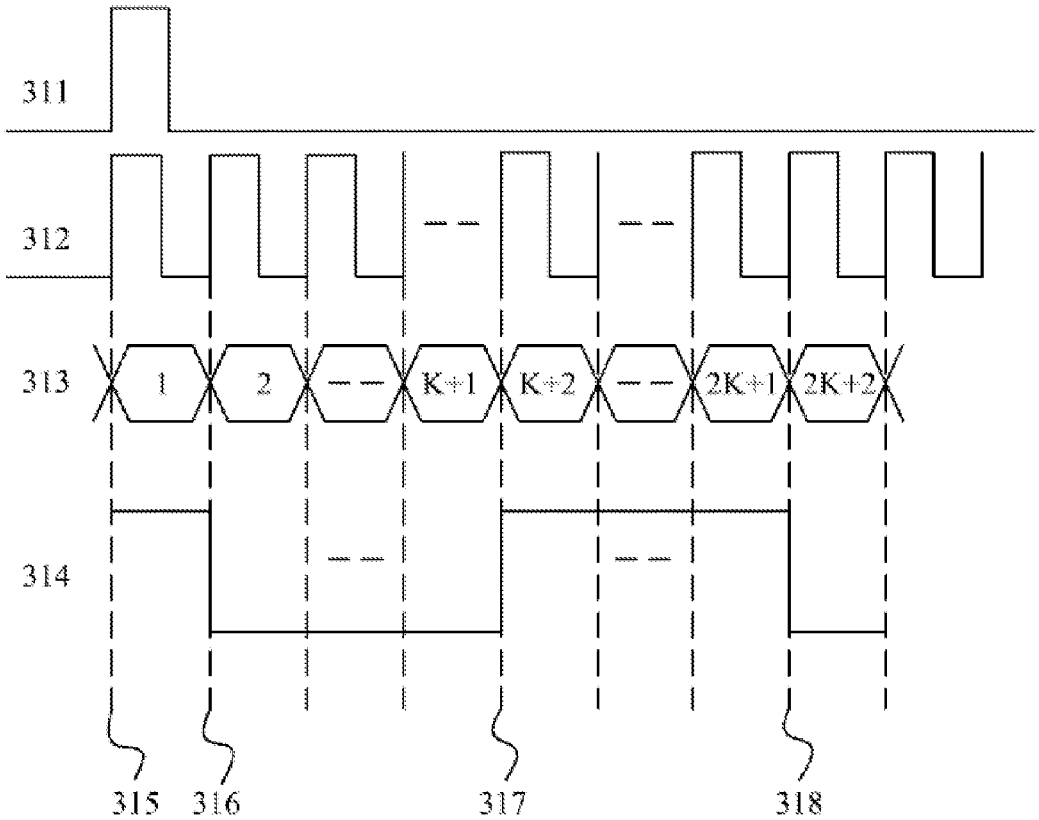
FIGS. 3A-3F illustrate the timing diagram of the driving method according to the embodiments of the present invention.
Figure 3B:
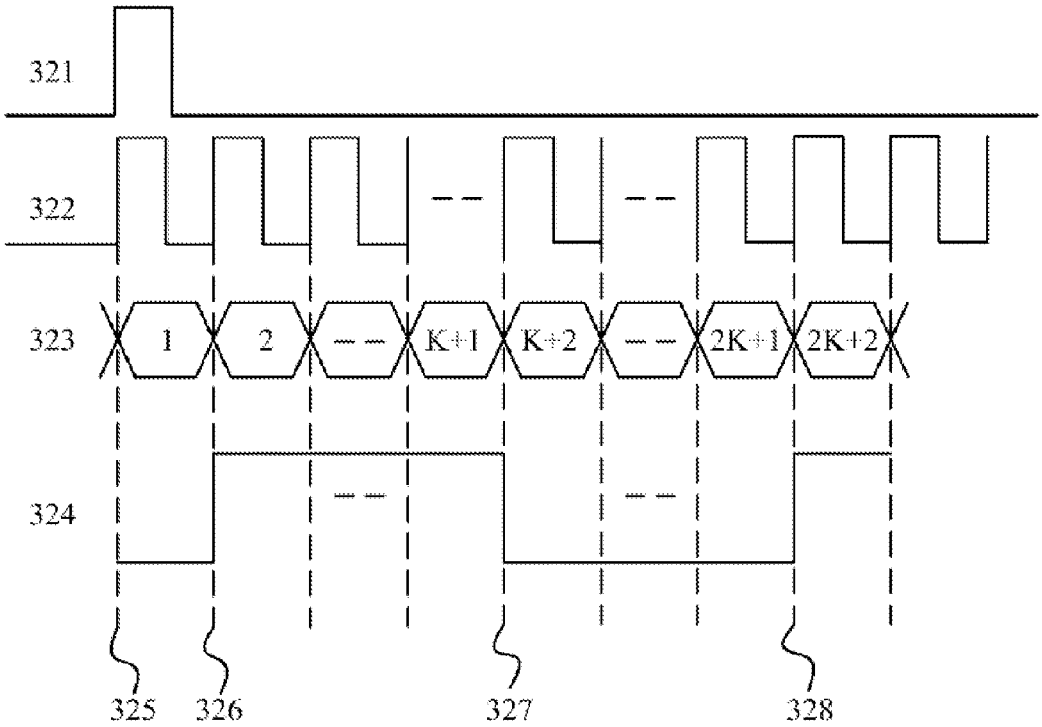

In the embodiments of the present invention, an improved driving method for TFT-LCD is provided. The method utilizes a timing controller to transmit polarity control signals to a plurality of source drivers, for changing the polarity distribution of the liquid crystal molecules within the panel. An AC power is coupled to the timing controller for generating AC control signals. FIGS. 3A-3F illustrate the timing diagram of the improved driving method according to the embodiments of the present invention. In FIG. 3A, it illustrates the information of STV 311, CLKV 312, RGB data 313, and "1+K" polarity distribution signal 314. In frame F(n+0), if the polarity of the first horizontal line is positive, then the polarities of the second to the "K+1" horizontal lines are negative, the polarities of the "K+2" to the "2K+1" horizontal lines are positive, and the other horizontal lines are distributed according to the same pattern, as shown in FIG. 3A. In frame F(n+1), if the polarity of the first horizontal line is negative, then the polarities of the second to the "K+1" horizontal lines are positive, the polarities of the "K+2" to the "2K+1" horizontal lines are negative, and the other horizontal lines are distributed according to the same pattern, as shown in FIG. 3B. Based on the illustration shown in FIGS. 3A and 3B, frames of F(n+0) and F(n+1) form a polarity distribution "1+K" (314 and 324). In other words, the first horizontal line is given a first polarity, and every K lines thereafter changes to the second or to the first polarity, alternatively. Besides, the frames of F(n+0) and F(n+1) comprise opposite polarity distributions.

Figure 3C:
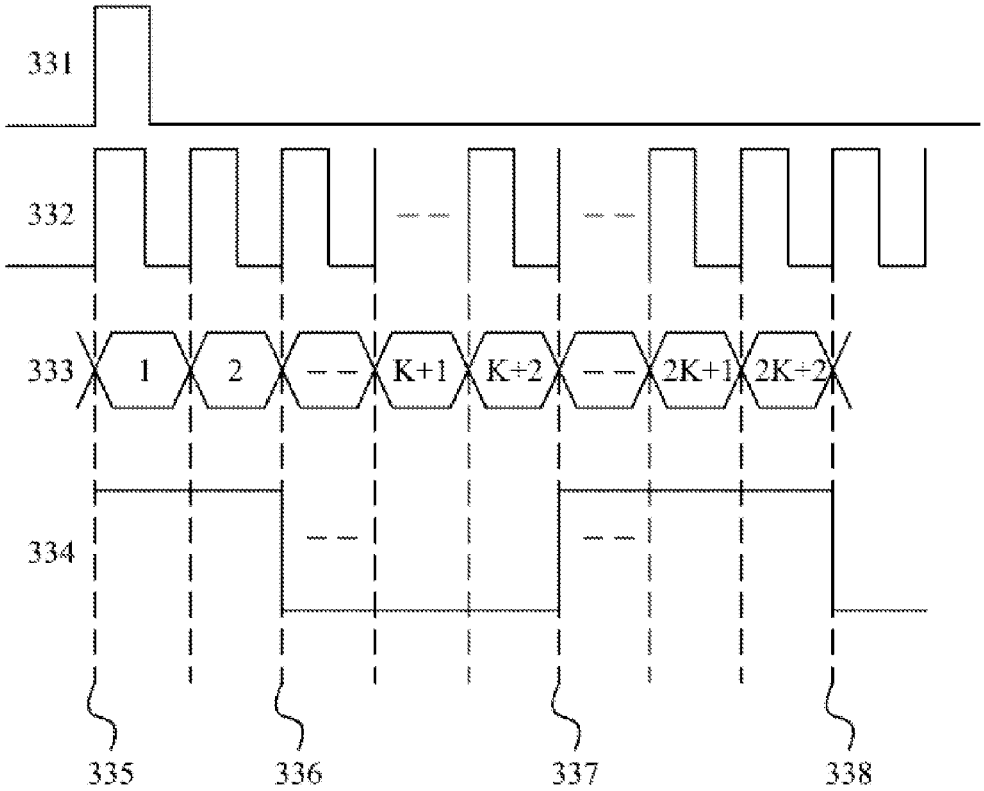
Figure 3D:
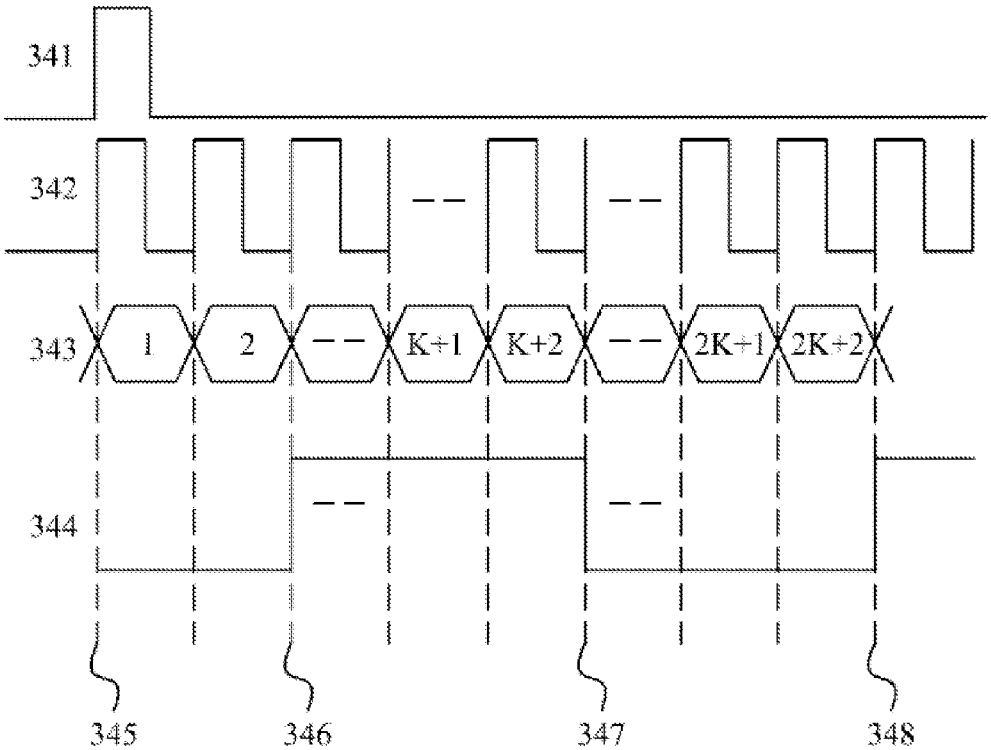

FIG. 3C illustrates the frame F(n+2), which comprising information of STV 331, CLKV 332, RGB data 333, and "2+K" polarity distribution signal 334. If the polarities of the first to the second horizontal lines are positive, then the polarities of the third to the "K+2" horizontal lines are negative, the polarities of the "K+3" to the "2K+2" horizontal lines are positive, and the other horizontal lines are distributed according to the same pattern, as shown in FIG. 3C. FIG. 3D illustrates the frame F(n+3), which comprising information of STV 341, CLKV 342, RGB data 343, and "2+K" polarity distribution signal 334. If the polarities of the first to the second horizontal line are negative, then the polarities of the third to the "K+2" horizontal lines are positive, the polarities of the "K+3" to the "2K+2" horizontal lines are negative, and the other horizontal lines are distributed according to the same pattern, as shown in FIG. 3D. Based on the illustration shown in FIGS. 3C and 3D, frames of F(n+2) and F(n+3) form a polarity distribution "2+K" (334 and 344). In other words, the first and second horizontal lines are given the first polarity, and every K lines thereafter changes to the second or to the first polarity, alternatively. Besides, the frames of F(n+2) and F(n+3) comprise opposite polarity distributions.

Figure 3E:
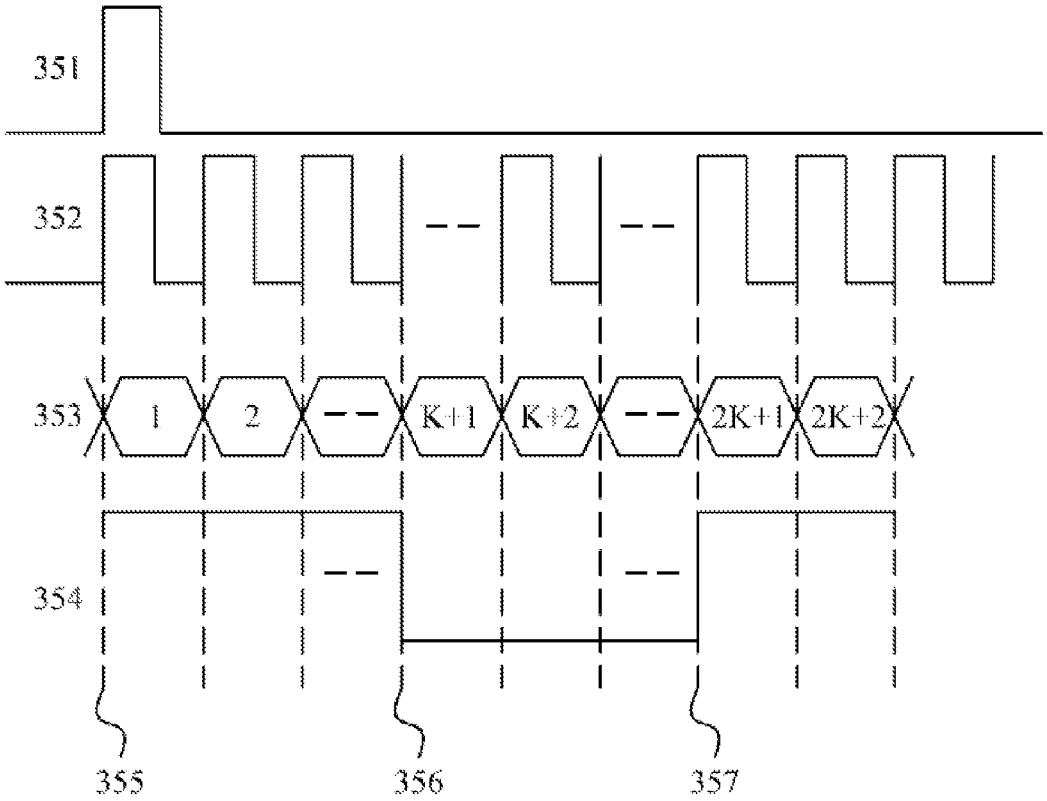
Figure 3F:
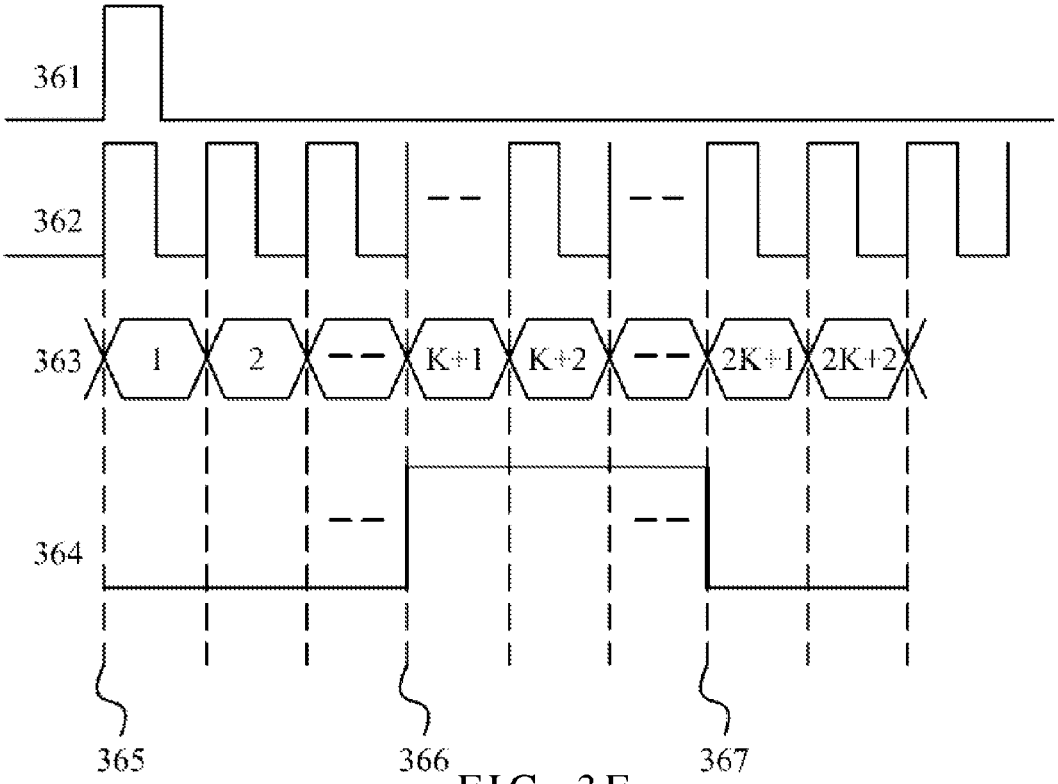
Figure 4:
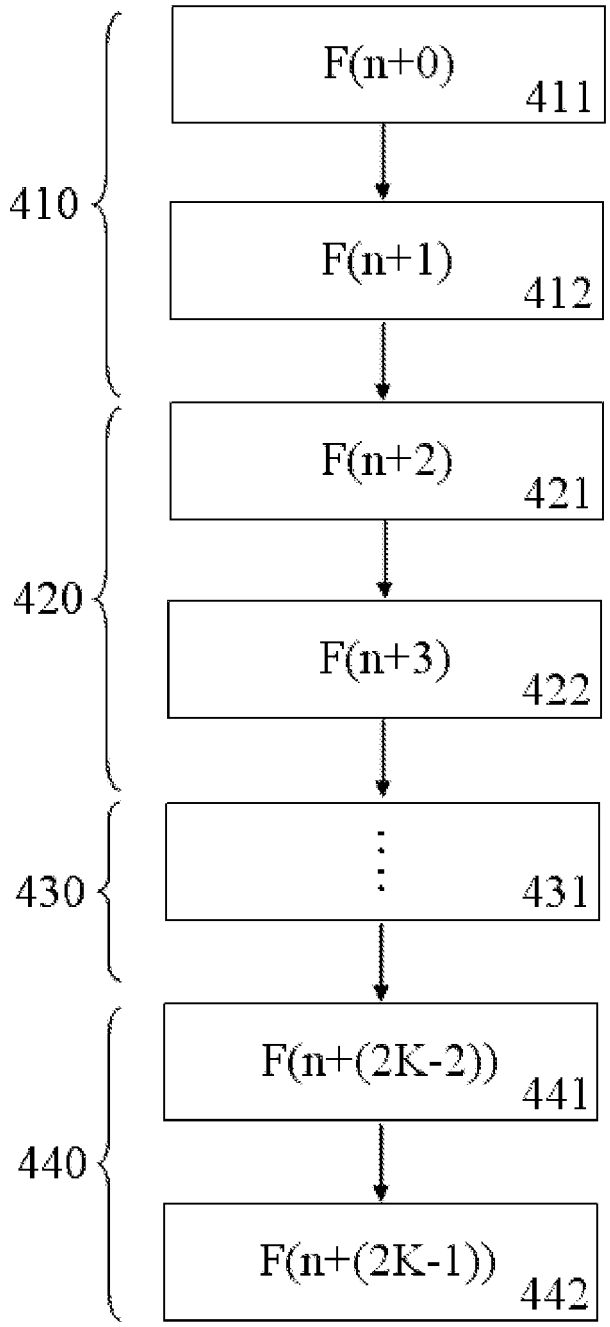
FIG. 4 illustrates the sequential diagram of the frames of the driving method according to the embodiments of the present invention.
Figure 5A:
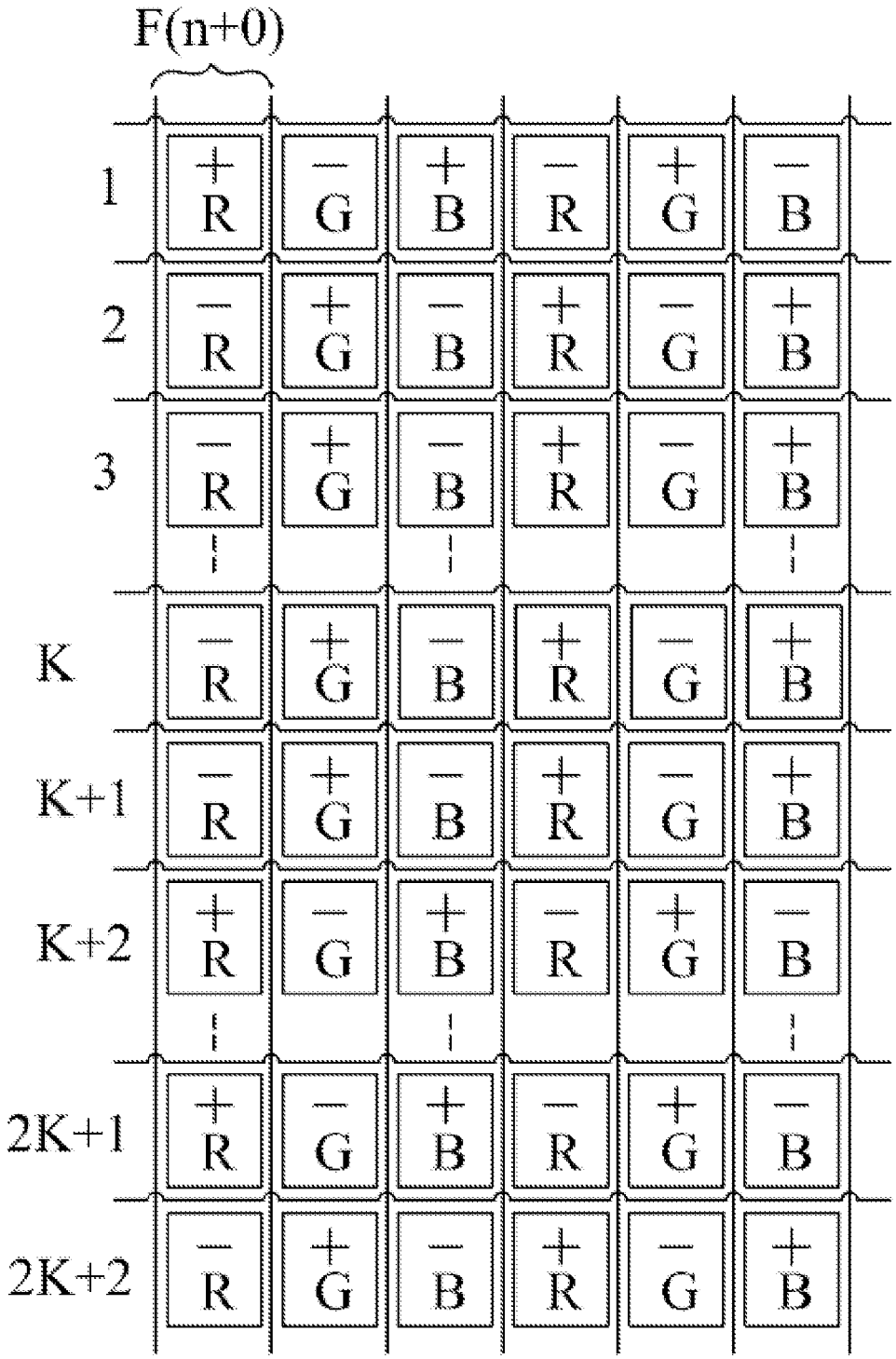
FIGS. 5A-5D illustrate the schematic diagram of the dynamically polarity inversion according to the embodiments of the present invention.
Figure 5B:
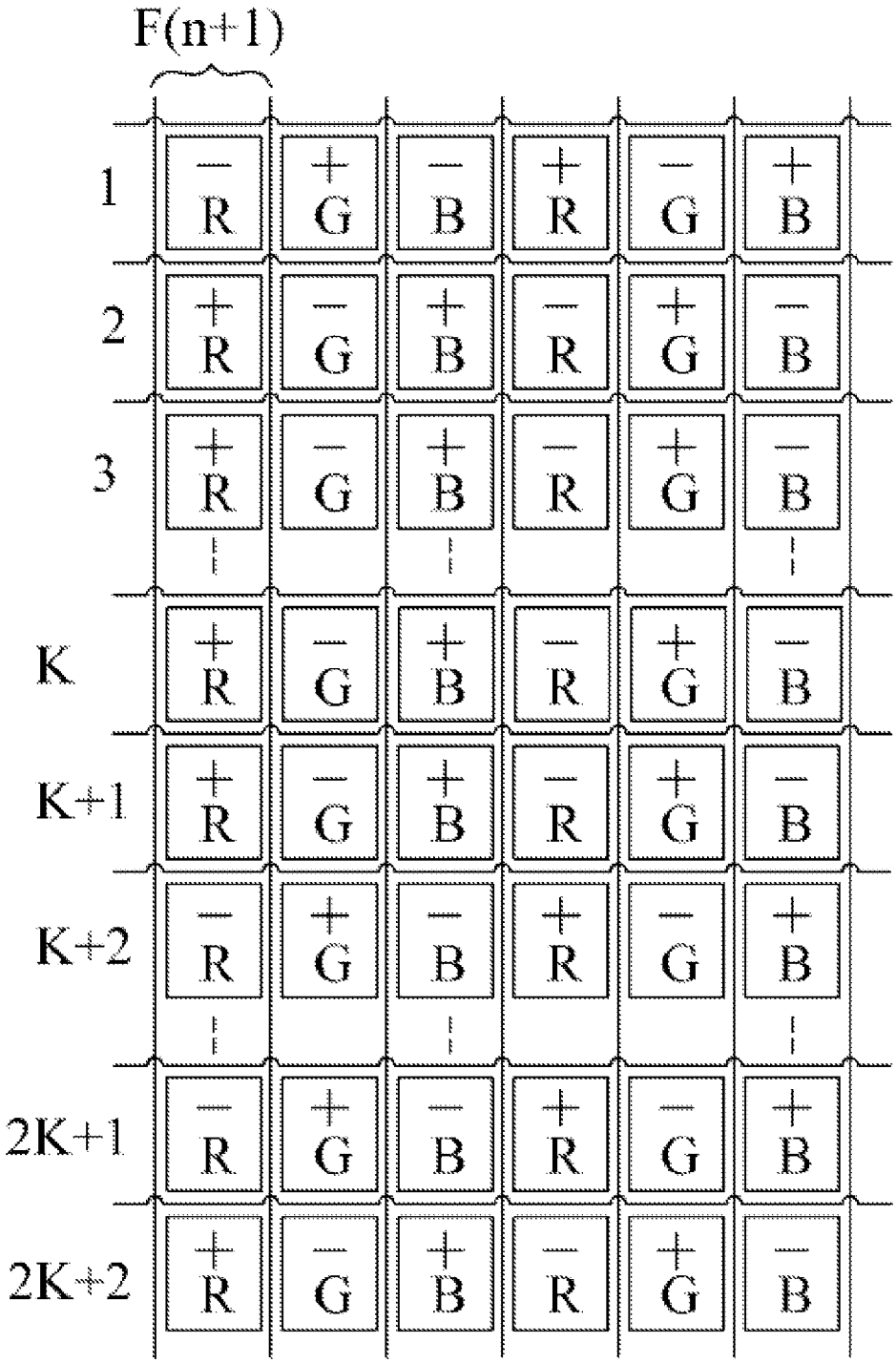
Figure 5C:
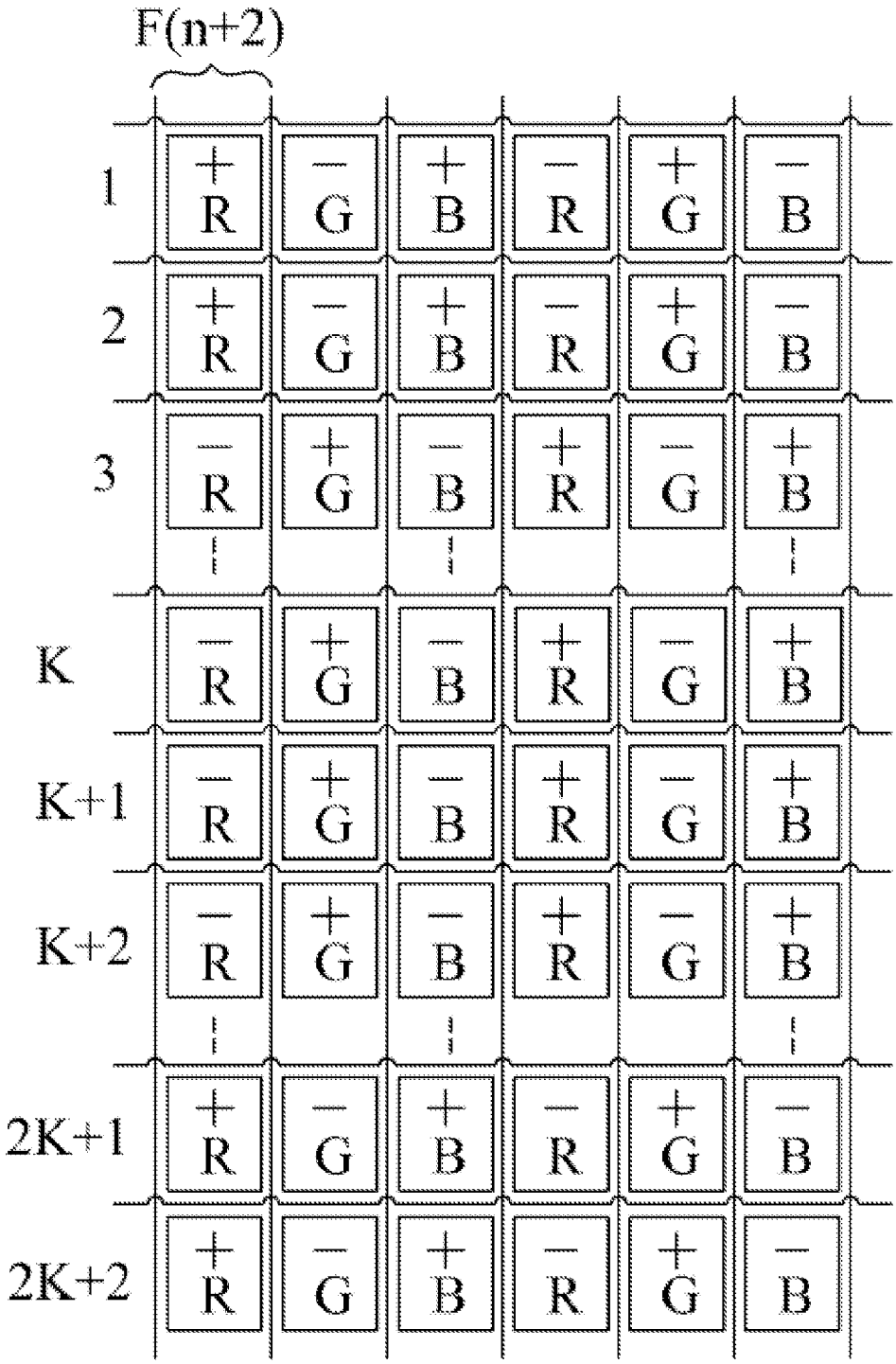
Figure 5D:
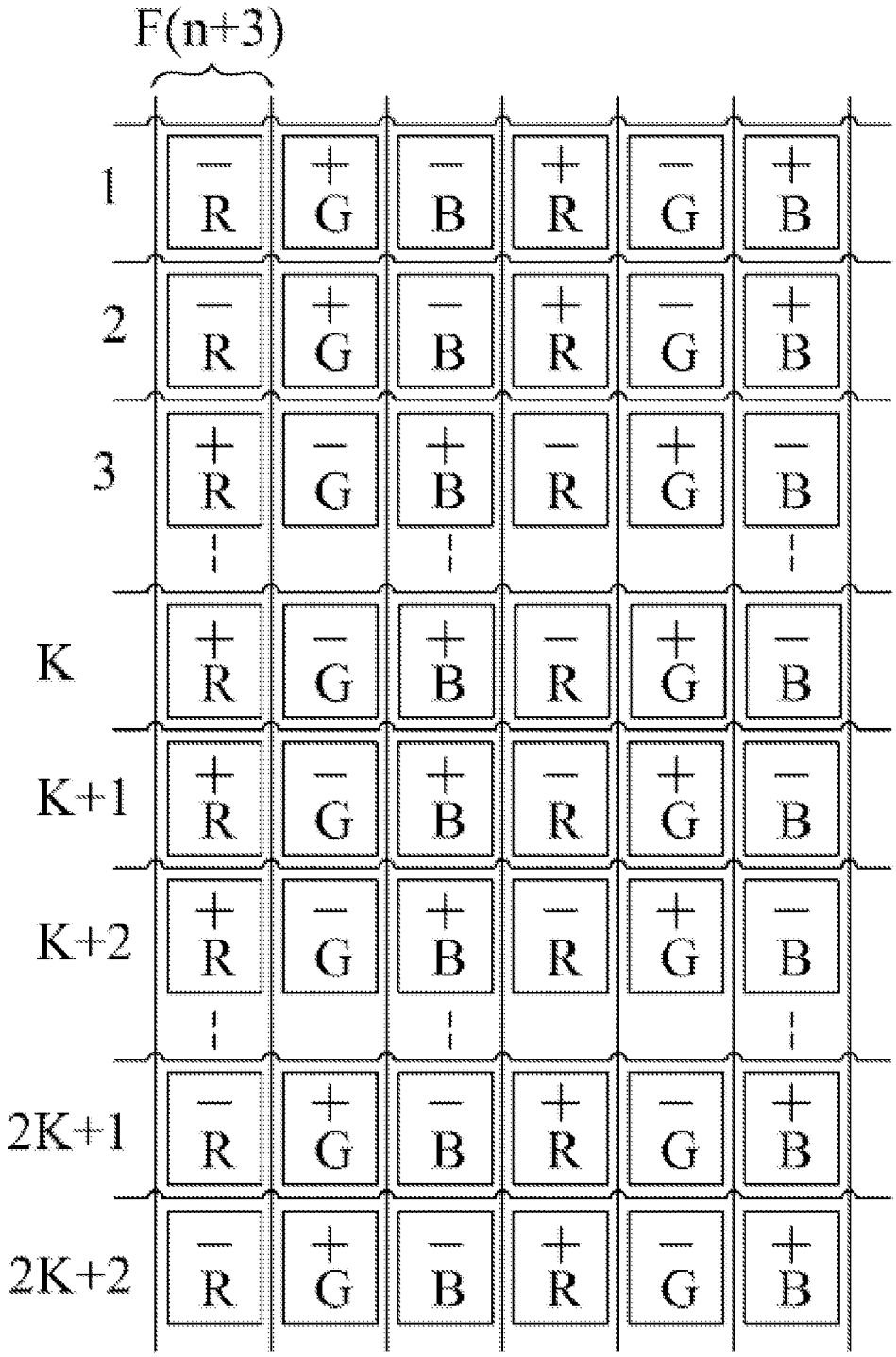

FIG. 3E illustrates the frame F(n+(2K−2)), which comprising information of STV 351, CLKV 352, RGB data 353, and "K" polarity distribution signal 354. If the polarities of the first to the "K" horizontal lines are positive, then the polarities of the "K+1" to the "2K" horizontal lines are negative, the polarities of the "2K+1" to the "3K" horizontal lines are positive, and the other horizontal lines are distributed according to the same pattern, as shown in FIG. 3E. FIG. 3F illustrates the frame F(n+(2K−1)), which comprising information of STV 361, CLKV 362, RGB data 363, and "K" polarity distribution signal 364. If the polarities of the first to the "K" horizontal lines are negative, then the polarities of the "K+1" to the "2K" horizontal lines are positive, the polarities of the "2K+1" to the "3K" horizontal lines are negative, and the other horizontal lines are distributed according to the same pattern, as shown in FIG. 3F. Based on the illustration shown in FIGS. 3E and 3F, frames of F(2K−2) and F(2K−1) form a polarity distribution "K" (354 and 364). In other words, the first to "K" horizontal lines are given the first polarity, and every K lines thereafter changes to the second or to the first polarity, alternatively. Besides, the frames of F(n+(2K−1)) and F(n+(2K−1)) comprise opposite polarity distributions. In above description, "n" means that the initial position to be selected, "n+1", "n+2", etc. refer to the sequential relationship, and "K" should be natural numbers. If the resolution of the panel is "1024×768", the value of K should be smaller than or equal to "768−1". For example, K can be assigned as "50". Further, as shown in FIGS. 3A and 3B, the polarity inversing positions in "1+K" mode (frame F(n+0) and F(n+1)) are at positions 315/325, 316/326, 317/327, 318/328, and other positions beyond the illustration. Similarly, as shown in FIGS. 3C and 3D, the polarity inversing positions in "2+K" mode (frame F(n+2) and F(n+3)) are at positions 335/345, 336/346, 337/347, 338/348, and other positions beyond the illustration. Similarly, as shown in FIGS. 3E and 3F, the polarity inversing positions in "K" mode (frame F(n+(2K−2)) and F(n+(2K−1))) are at positions 355/365, 356/366, 357/367, and other positions beyond the illustration. In prior arts, the brightness at each of the polarity inversing positions are unbalanced due to undercharging. The problem is more critical in a panel with better specification such as resolution of "1920×1080" and renew frequency of "120" Hz. In prior arts, line inversion or multi-line inversion approach inverses the polarity at fixed line positions, thereby the capacitors at same positions are always being undercharged and the unbalance of brightness should be obvious. In contrast, in the embodiments of the present invention, utilizing the above-mentioned driving method that the polarity inversing positions are dynamically changed, the above-mentioned problem can be obviously alleviated. For example, in FIGS. 3A and 3B, the polarities are inversed at positions 316/326, 317/327, 318/328, 319/329, etc. In FIGS. 3C and 3D, the polarities are inversed at positions 336/346, 337/347, 338/348, etc. In FIGS. 3E and 3F, the polarities are inversed at 356/366, 357/367, etc. Accordingly, in dynamical polarity inversion comprising modes of "1+K", "2+K", "K", etc., the polarity inversing positions are always switched with different positions, and thus the positions currently being undercharged can be immediately fully charged in the next mode. Further, the problem of brightness unbalance caused by undercharging of capacitors is eased by averaging effect upon the dynamically switching processes. FIG. 4 shows the sequential diagram of the frames according to the embodiments of the present invention. In step 411, frame F(n+0) is implemented. Then, in step 412, 421, 422, 431, 441, 442, etc., F(n+1), F(n+2), F(n+3), F(n+4), F(n+5), F(n+6), etc. are implemented, respectively. Wherein step 431 may comprise implementing of F(n+4), F(n+5), F(n+6), and/or other possible candidates, and it is dependent on the predetermined value K. Further, frames F(n+0) and F(n+1) are classified as "1+K" (polarity distribution) mode 410, frames F(n+2) and F(n+3) are classified as "2+K" mode, F(n+(2K−2)) and F(n+(2K−1)) are classified as "K" mode, and the possible candidates F(n+4) and F(n+5) are classified as 430 (other modes). FIGS. 5A-5D illustrate part of the displaying frame (comprising a plurality of pixels) in mode "1+K" and "2+K". In FIG. 5A, for example, the polarity distribution of the first vertical line which is marked with "F(n+0)" is arranged according to the "1+K" polarity distribution 314 shown in FIG. 3A, and each of the pixels on the second vertical line are arranged with polarities opposite to each of the pixels on the first vertical line, respectively. The vertical lines thereafter are arranged according to the same pattern.

The description above may be alternatively represented as frames of F(2R−2) and F(2R−1), wherein R is natural number from 1 to K, and K is natural number which is smaller or equal to the horizontal line number of the panel minus one. This can be implemented by a method comprising: step (a), setting value of K; step (b), setting each of first pixels on 1 to R horizontal lines of frame F(2R−2) as positive polarity, setting each of first pixels on R+1 to R+K horizontal lines of frame F(2R−2) as negative polarity, and setting each of first pixels on every K lines thereafter as alternate positive and negative polarities; setting each of first pixels on 1 to R horizontal lines of frame F(2R−1) as negative polarity, setting each of first pixels on R+1 to R+K horizontal lines of F(2R−1) as positive polarity, and setting each of first pixels on every K lines thereafter as alternate negative and positive polarities; in step (c), repeating the step (b) while substituting R from 1 to K with interval of 1; and in step (d), displaying the frames F(2R−2) and F(2R−1) by sequence of comparing values of 2R−2 and 2R−1 substituted with different R. Further, via a frame initial position setting step (may be implemented as a frame initial position setting module), the frame initial position mark "n" is brought into frames F(2R−2) and F(2R−1) and represented as F(n+(2R−2)) and F(n+(2R−1)), for identifying initial positions of the frames. Furthermore, if the renew frequency of a TFT-LCD is setting as M (M>K) frames per second, then the method further comprises a frame recurring step, to display the frames reiteratively for satisfying the renew frequency. The method may further comprise a horizontal line pixel distribution step (may be implemented by a horizontal line pixel distribution module), for setting the polarities of other pixels according to the first pixels of each of horizontal lines. For example, the polarity of the second pixel is opposite to the first pixel, the polarity of the third pixel is opposite to the second pixel, and so on. A distribution with alternate positive and negative polarities is generated. However, in other embodiments of the present invention, all the pixels on one horizontal line can be alternatively with the same polarity as omitting the above step.

In the embodiments of the present invention, a relative smaller K brings relative more times of polarity inversions, and the electric power consumption becomes higher. Therefore, in preferred embodiments of the present invention, a relative larger K, such as K≥50, is chosen for reducing the inversion times, for lowering the electric power consumption and the heat generated. However, it should be noted that in conditions of choosing relative larger K, the positions except for the polarity inversion positions (referring to continuous portions of the polarity inversion signal curve) may exhibit the behavior similar to those in line inversion approach. For preventing the green color shift problem under the checker board testing signals, in other embodiments of the present invention, the source drivers in an improved TFT-LCD are implemented as combinations of power of line (POL) and power of line reverse (POLR) polarity control signals. For example, the plurality of source drivers can be classified as odd source drivers and even source drivers, and the odd source drivers and the even source drivers may be provided with polar driving signals and reverse polar driving signals (may be implemented by coupling a NOT gate to part of the ends of the timing controller, for providing polar source drivers and reverse polar source drivers), respectively. FIGS. 6A and 6B show the displaying frames with "1×1" checker board testing signals according to the embodiments of the present invention, wherein the "R", "G", "B", and "K" represent red, green, blue, and black, respectively. FIG. 6A illustrates the pixels driven by polar source driver. In the first and second rows illustrated in FIG. 6A, the increased 4V from the pixel 6111 to the pixel 6121 is balanced with the decreased 4V from the pixel 6112 to the pixel 6122. The increased 4V from the pixel 6114 to the pixel 6124 is balanced with the decreased 4V from the pixel 6115 to the pixel 6125 as well. One of the improvements of the embodiment is that the voltage increases from the pixel 6113 to the pixel 6123 and from the pixel 6116 to the pixel 6126 will not cause the green color shift problem. It is credited to the existence of voltage decreases from the pixel 6213 to the pixel 6223 and from the pixel 6216 to the pixel 6226 shown in FIG. 6B (driven by reverse polar driving signals), while the voltage changes among other pixels 6211, 6221, 6212, 6222, 6214, 6224, 6215, and 6225 are balanced. Further, when the second row and the third row are considered, for example, the voltage changes of pixels 6121, 6131, 6122, and 6132 are balanced, and the voltage changes of pixels 6124, 6134, 6125, and 6135 are balanced as well. The left voltage decreases from pixels 6123 to 6133 and from pixels 6126 to 6136 can be balanced with the voltage increases from pixels 6223 to 6233 and from pixels 6226 to 6236, as shown in FIG. 6B. Therefore, the problem of green color shift is not happened. The above-mentioned solution can be implemented by a polarity distribution setting step, for setting the plurality of odd source drivers and even source drivers as opposite polarity distribution.

Figure 7A:
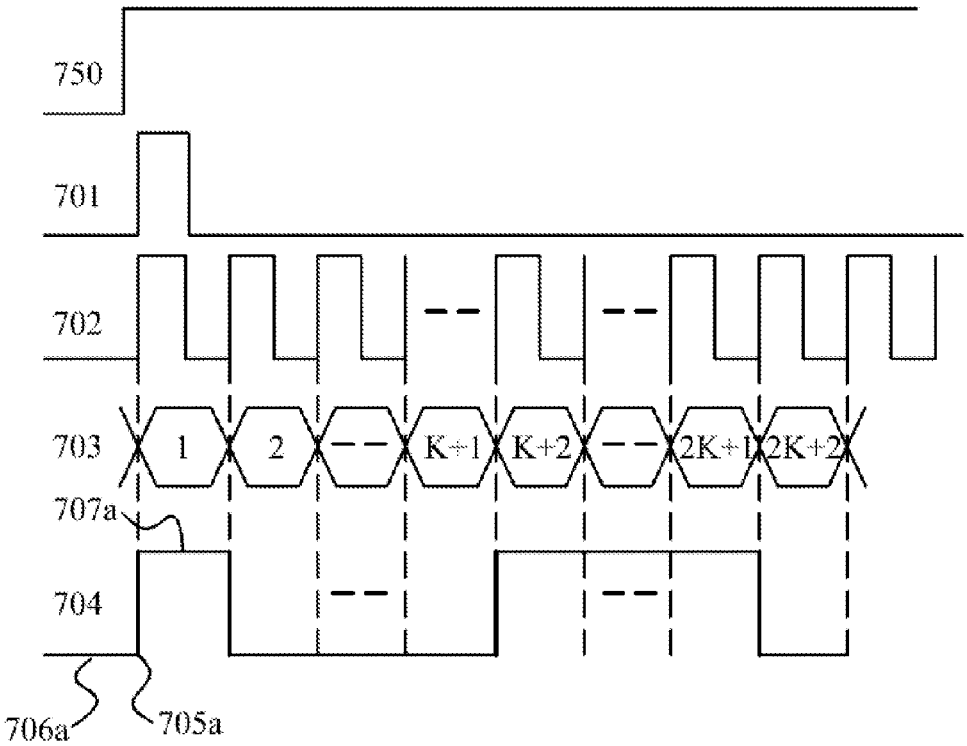
FIGS. 7A and 7B illustrate the schematic diagram of method for improving the undercharging problem according to the embodiments of the present invention.
Figure 7B:
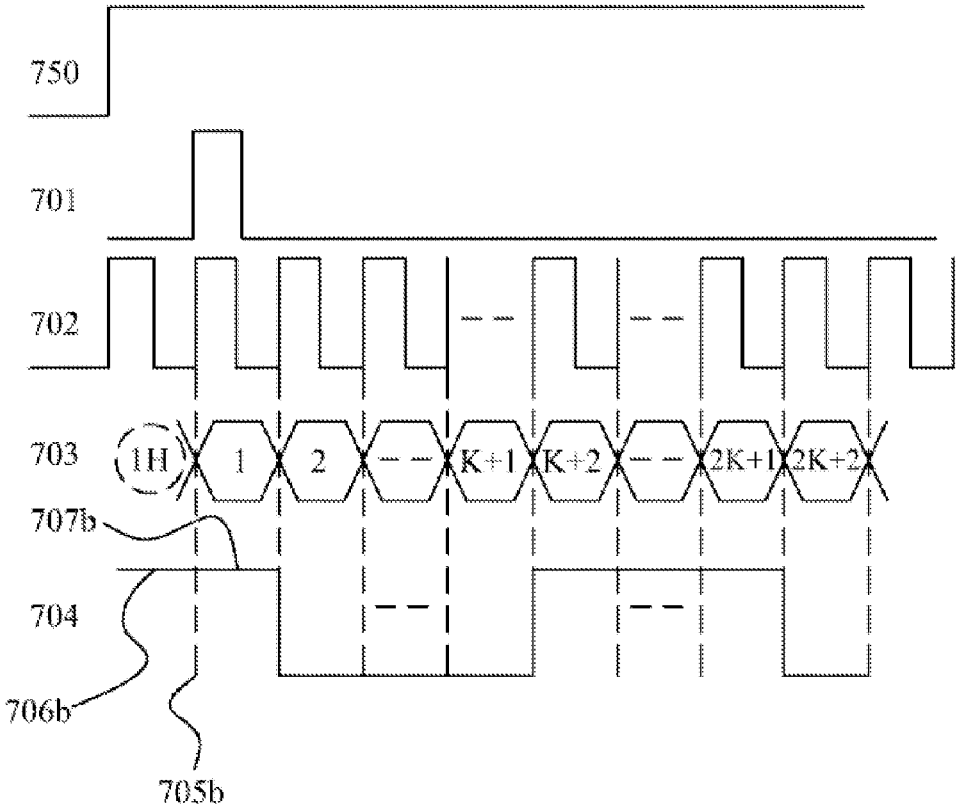

In other embodiments of the present invention, the undercharging problem at the first lines, marked as "1" in the RGB data 313, 323, 333, 343, 353, and 363, are solved by coupling two horizontal storage units, such as memories, to the timing controller, while the undercharging problem at other lines can be solved by the dynamically polarity inversion method mentioned above. Taking "1+K" polarity mode and the frame F(n+0) as example, the exemplary timing diagrams for improving the undercharging problem are shown in FIGS. 7A and 7B. In FIG. 7A, in addition to information of STV 701, CLKV 702, RGB data 703, and "1+K" polarity distribution signal 704, the diagram further comprises data enable (DE) signal (or data initiating signal) 750 which may be implemented by a signal generating module coupled to the timing controller. When the DE signal 750 is high (from position 705*a*), the polarity data of the first horizontal line (first horizontal data, for brevity) of the frame is stored within the first horizontal memory. The polarity data of the next horizontal line is then set to be the same with the original first horizontal data, and the first horizontal data to be transmitted to source driver is substituted with "V-Blanking" signal to delay a unit time "1H" for the STV 701. At the second horizontal line position after the DE signal 750 is high, the original second horizontal data is stored within the second horizontal memory. Then, the STV 701 is enabled, for transmitting the data stored within the first horizontal memory to the source drivers, and then the data stored within the second horizontal memory is transmitted to the source drivers consequently. The processes of the third horizontal line and the horizontal lines thereafter follow the same way, for solving the undercharging problem at the first line of the panel by delaying the enable time. In other words, the horizontal lines 706*a* and 707*a*, illustrated around the polarity inversing position 705*a*, are originally distributed with opposite polarities, but the polarities of horizontal lines 706*b* and 707*b* are identical after the above-mentioned processes. Therefore, it is achieved for preventing inversing polarity at the position 705*b*, and the undercharging problem is thus solved.

From the above description, it should be appreciated that the embodiments of the present invention implement a driving method by a driving device, for solving problems existed in driving circuit of the conventional LCD panel. For example, the brightness unbalance of lines, the green color shift problem with checker board testing signals, and the undercharging problem at the first horizontal lines can be solved. In addition, according to the embodiments of the present invention, the driving device does not cause apparently additional electric power consumption. Taking a 37" TFT-LCD with resolution of "1920×1080" for example, if the total impedance of wiring of the source drivers is about 8.5 kohm, the total capacitance is about 200 nF, the number of source driver channels is about 720, and the driving voltage is room temperature (about 25° C.), the electric power consumption comparisons of the embodiment of the present invention to the conventional approaches are listed in TAB. 1.

TABLE 1

| | | 60 Hz | 120 Hz |
|---|---|---|---|
| Power consumption (mW) | Dot inversion | 419 | 702 |
| | Conventional "1 + 2" line inversion | 303 | 470 |
| | Embodiment of the present invention (K = 50) | 192 | 247 |
| Temperature when operating (° C.) | Dot inversion | 95 | 145 |
| | Conventional "1 + 2" line inversion | 73 | 101 |
| | Embodiment of the present invention (K = 50) | 55 | 64 |

In some embodiments, a storage medium readable by a timing controller is provided. The storage medium stores a program of instructions executable by the timing controller to perform a method for driving a panel of a liquid crystal display, for sending polarity control signals to a plurality of source drivers in the panel. The method comprises the steps mentioned above.

The description above provides the preferred embodiments of the present invention. The present should be thoroughly understood by ordinary skill in the art via the teachings. However, it should be noted that the description above and the accompanying figures may not illustrate all the details, such as the detailed conventional components. However, it should be appreciated that the driving device for implementing the driving method should comprise but not limit to a control chip, an assembly of touch panel, a housing, and/or other related components. Relative software, hardware, and/or firmware should also be included. Some of them are not described in detail for purpose of being easier to be understood of the embodiments of the present invention. Furthermore, the scope of the present invention is intended to be defined by the following claims and the equivalents.

What is claimed is:

1. A method for driving liquid crystal display, utilizing a timing controller to send polarity control signals to a plurality of source drivers in a display panel, said method comprising:

step (a), setting value of K;

step (b), setting each of first pixels of 1 to R horizontal lines of frames F(2R−2) as first polarity, setting each of first pixels of R+1 to R+K horizontal lines of said frames F(2R−2) as second polarity, and alternating polarity of each of first pixels of every K horizontal lines thereafter of said frames F(2R−2) between said first polarity and said second polarity, wherein R is natural number from 1 to K, and K is natural number which is smaller or equal to number of said horizontal lines subtracting 1; setting each of first pixels of 1 to R horizontal lines of frames F(2R−1) as said second polarity, setting each of first pixels of R+1 to R+K horizontal lines of said frames F(2R−1) as said first polarity, and alternating polarity of each of first pixels of every K horizontal lines thereafter of said frames F(2R−1) between said second polarity and said first polarity;

step (c), repeating step (b) while substituting R from 1 to K with interval of 1;

step (d), displaying the frames F(2R−2) and F(2R−1) according to sequence generated by comparing values of 2R-2 and 2R−1 substituted with different R; and step (e), an undercharging improving step comprising: providing a plurality of data storage units; providing a data enable signal; storing polarity data of said first pixels of said first horizontal lines of said frames F(2R−2) and (2R−1) into first data storage unit of said plurality of data storage units; setting first pixels of next horizontal lines of said frames F(2R−2) and F(2R−1) as identical to said first pixels of said first horizontal lines and storing into said first data storage unit; delaying start pulse vertical signal one unit time according to said data enable signal; storing polarity data of first pixels of second horizontal lines of said frames F(2R−2) and (2R−1) into second data storage unit of said plurality of data storage units; transmitting data stored in said first data storage unit to said plurality of source drivers when said starting pulse vertical signal is started; transmitting data stored in said second data storage unit to said plurality of source drivers in next timing unit; and reiteratively storing polarity data of first pixels of horizontal lines thereafter to said plurality of data storage units, and transmitting said polarity data of first pixels of horizontal lines thereafter to said plurality of source drivers in the next timing unit.

2. The method according to claim 1, wherein said sequence is ascending order or descending order sequence.

3. The method according to claim 1, wherein said polarity control signals are AC control signals.

4. The method according to claim 1, further comprising a frame initial position setting step, to present said frames F(2R−2) and F(2R−1) as F(n+(2R−2)) and F(n+(2R−1)), for identifying frame initial positions.

5. The method according to claim 1, further comprising a frame recurring step, to reiteratively display frames for satisfying a renew frequency M while M>K.

6. The method according to claim 1, further comprising a horizontal line pixel distribution step, to set polarities of second pixels of each of said horizontal lines of said frames F(2R−2) and F(2R−1) as opposite to polarities of said first pixels, to set polarities of third pixels as opposite to said polarities of said second pixels, and to set polarities of pixels thereafter with the same pattern, for generating polarity distribution comprising alternate said first polarity and said second polarity; wherein if said first pixels are set as said first polarity, then said second pixels are set as said second polarity.

7. The method according to claim 1, further comprising a polarity distribution setting step, for assigning odd ones and even ones of said plurality of source drivers with polar driving signals and reverse polar driving signals.

8. The method according to claim 1, further comprising an undercharging improving step, for changing said polarity of polarity control signals to be the same as the polarity of said first pixels before said polarity of first pixels are generated.

9. A non-transitory storage medium readable by a timing controller, said storage medium storing a program of instructions executable by said timing controller to perform a method for driving a panel of a liquid crystal display, for sending polarity control signals to a plurality of source drivers in said panel, said method comprising:

step (a), setting value of K;

step (b), setting each of first pixels of 1 to R horizontal lines of frames F(2R−2) as first polarity, setting each of first pixels of R+1 to R+K horizontal lines of said frames F(2R−2) as second polarity, and alternating polarity of each of first pixels of every K horizontal lines of said frames F(2R−2) between said first polarity and said second polarity, wherein R is natural number from 1 to K, and K is natural number which is smaller or equal to number of said horizontal lines subtracting 1; setting each of first pixels of 1 to R horizontal lines of frames F(2R−1) as said second polarity, setting each of first pixels of R+1 to R+K horizontal lines of said frames F(2R−1) as said first polarity, and alternating polarity of each of first pixels of every K horizontal lines of said frames F(2R−1) between said second polarity and said first polarity;

step (c), repeating step (b) while substituting R from 1 to K with interval of 1;

step (d), displaying the frames F(2R−2) and F(2R−1) according to sequence generated by comparing values of 2R-2 and 2R−1 substituted with different R; and step (e), an undercharging improving step comprising: providing a plurality of data storage units; providing a data enable signal; storing polarity data of said first pixels of said first horizontal lines of said frames F(2R−2) and (2R−1) into first data storage unit of said plurality of data storage units; setting first pixels of next horizontal lines of said frames F(2R−2) and F(2R−1) as identical to said first pixels of said first horizontal lines and storing into said first data storage unit; delaying start pulse vertical signal one unit time according to said data initial signal; storing polarity data of first pixels of second horizontal lines of said frames F(2R−2) and (2R−1) into second data storage unit of said plurality of data storage units; transmitting data stored in said first data storage unit to said plurality of source drivers when said starting pulse vertical signal is started; transmitting data stored in said second data storage unit to said plurality of source drivers in next timing unit; and reiteratively storing polarity data of first pixels of horizontal lines thereafter to said plurality of data storage units, and transmitting said polarity data of first pixels of horizontal lines thereafter to said plurality of source drivers in the next timing unit.

10. The non-transitory storage medium according to claim 9, wherein said sequence is ascending order or descending order sequence.

11. The non-transitory storage medium according to claim 9, wherein polarity control signals are AC control signals.

12. The non-transitory storage medium according to claim 9, further comprising a frame initial position setting step, to present said frames F(2R−2) and F(2R−1) as F(n+(2R−2)) and F(n+(2R−1)), for identifying frame initial positions.

13. The non-transitory storage medium according to claim 9, further comprising a frame recurring step, to reiteratively display frames for satisfying a renew frequency M while M>K.

14. The non-transitory storage medium according to claim 9, further comprising a horizontal line pixel distribution step, to set polarities of second pixels of each of said horizontal lines of said frames F(2R−2) and F(2R−1) as opposite to polarities of said first pixels, to set polarities of third pixels as opposite to said polarities of said second pixels, and to set polarities of pixels thereafter with the same pattern, for generating polarity distribution comprising alternate said first polarity and said second polarity; wherein if said first pixels are set as said first polarity, then said second pixels are set as said second polarity.

15. The non-transitory storage medium according to claim 9, further comprising a polarity distribution setting step, for assigning odd ones and even ones of said plurality of source drivers with polar driving signals and reverse polar driving signals.

16. The non-transitory storage medium according to claim 9, further comprising an undercharging improving step, for changing said polarity of polarity control signals to be the same as the polarity of said first pixels before said polarity of first pixels are generated.

* * * * *